US005570930A

United States Patent [19]

LaPointe et al.

[11] Patent Number: 5,570,930

[45] Date of Patent: Nov. 5, 1996

[54] RECLINER CHAIR SEAT ASSEMBLY AND METHOD OF UPHOLSTERING

[75] Inventors: Larry P. LaPointe, Temperance, Mich.; Douglas A. Habegger, Millbury, Ohio; Jonathan R. Saul, LaSalle, Mich.; Karl J. Komorowski, Petersburg, Mich.; Richard E. Marshall, Monroe, Mich.

[73] Assignee: La-Z-Boy Chair Company, Monroe, Mich.

[21] Appl. No.: 319,672

[22] Filed: Oct. 12, 1994

Related U.S. Application Data

[63] Continuation-in-part of Ser. No. 101,515, Aug. 9, 1993, abandoned, which is a continuation-in-part of Ser. No. 100,916, Aug. 9, 1993, Pat. No. 5,435,621.

[51] Int. Cl.[6] ..... A47C 1/02

[52] U.S. Cl. ..... 297/342; 297/85; 297/440.21; 297/DIG. 7

[58] Field of Search ..... 297/440.11, 228.13, 297/440.21, 85, 452.52, 440.22, 452.18, 218.3, 342, DIG. 7, 258.1

[56] References Cited

U.S. PATENT DOCUMENTS

| | | | |
|---|---|---|---|
| 1,048,306 | 12/1912 | Greilick . | |
| 2,677,412 | 5/1954 | Thomas . | |
| 3,096,121 | 7/1963 | Knabusch et al. . | |
| 3,567,280 | 3/1971 | Bradshaw . | |
| 3,869,169 | 3/1975 | Johnson et al. . | |
| 3,869,172 | 3/1975 | James et al. . | |
| 4,179,157 | 12/1979 | Shoemaker et al. . | |
| 4,350,387 | 9/1982 | Rogers, Jr. . | |
| 4,367,895 | 1/1983 | Pacitti et al. . | |
| 4,861,104 | 8/1989 | Malak | 297/452.52 X |
| 5,217,276 | 6/1993 | Saul et al. . | |
| 5,271,660 | 12/1993 | LaPointe et al. . | |
| 5,288,126 | 2/1994 | Saul et al. . | |
| 5,301,413 | 4/1994 | Habegger et al. . | |

FOREIGN PATENT DOCUMENTS

| | | |
|---|---|---|
| 0123404 | 6/1987 | European Pat. Off. . |

*Primary Examiner*—Milton Nelson, Jr.
*Attorney, Agent, or Firm*—Harness, Dickey & Pierce, P.L.C.

[57] ABSTRACT

A modular reclining chair and method for assembling it are disclosed. The reclining chair seat assembly includes an improved seat frame which can be readily adapted for use with a variety of recliner chair configurations. The recliner chair seat assembly further includes a unique seat cushion that can be releaseably attached to a seat frame to facilitate assembly and service of the reclining chair.

43 Claims, 10 Drawing Sheets

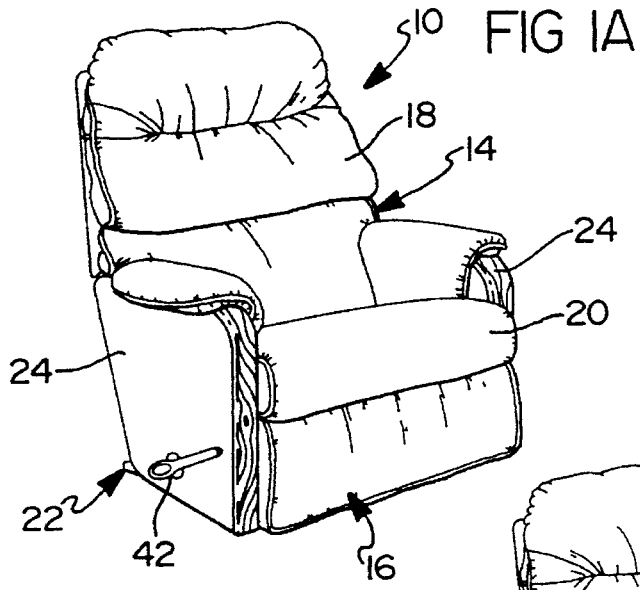
FIG IA
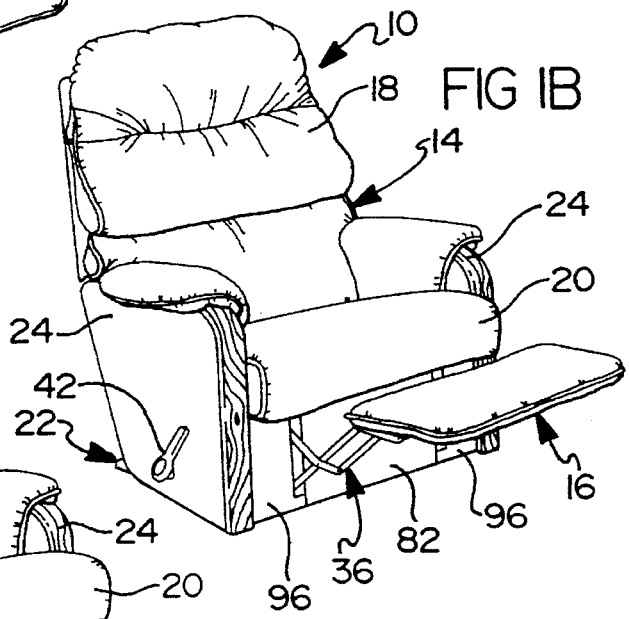
FIG IB
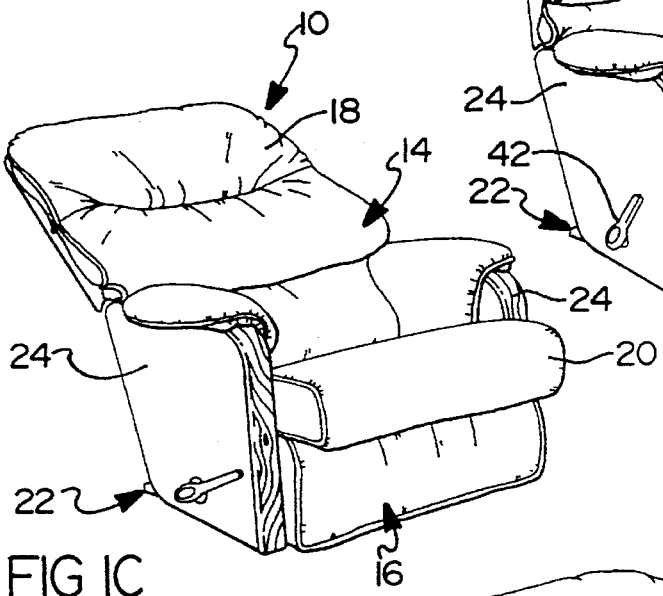
FIG IC
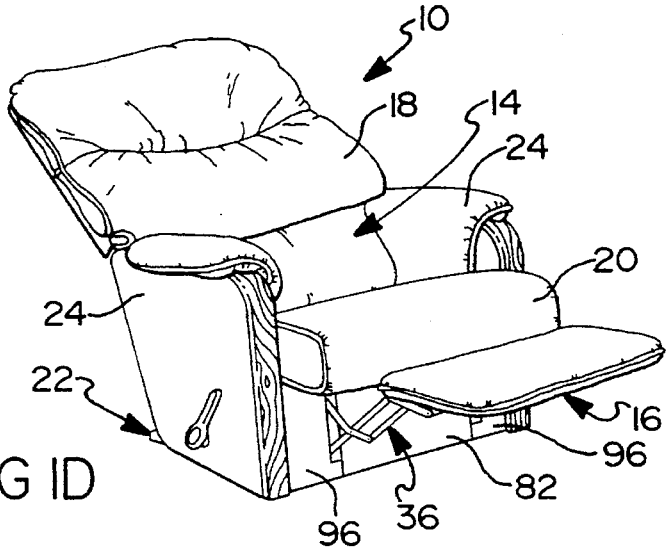
FIG ID

FIG 6
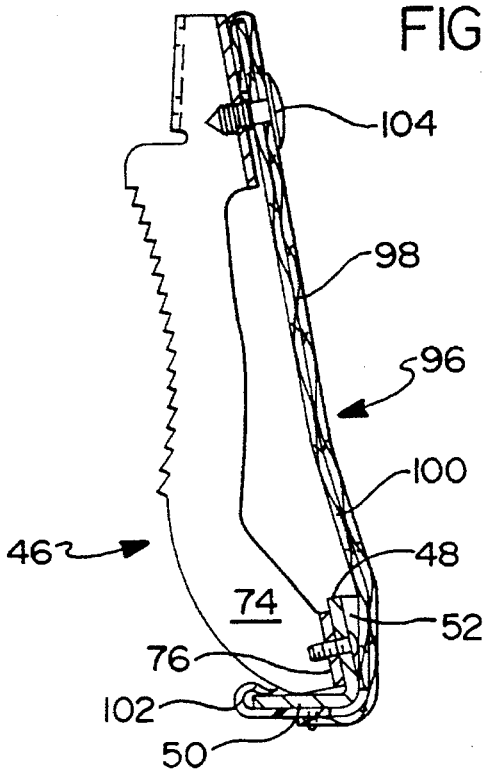
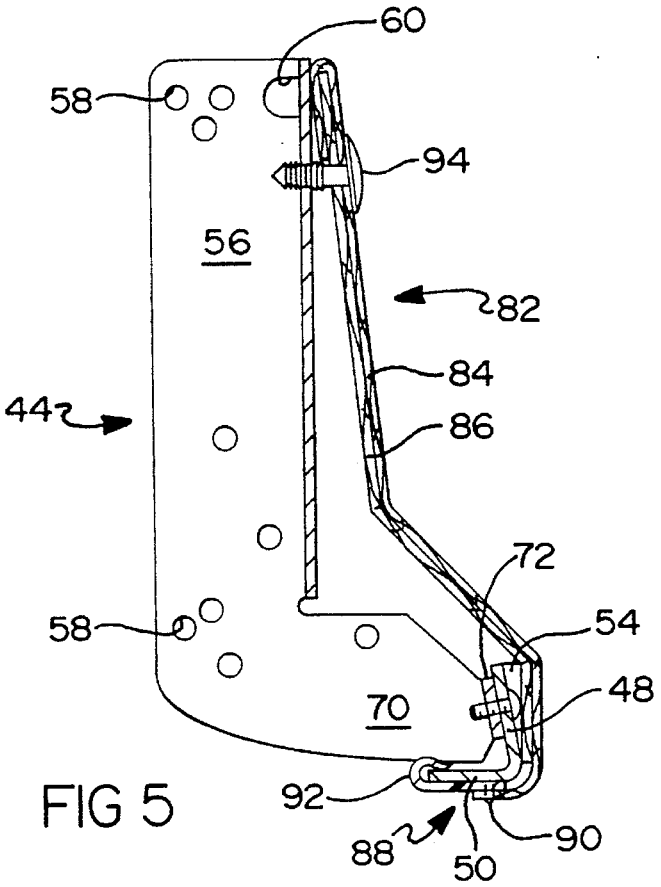
FIG 5

FIG 7
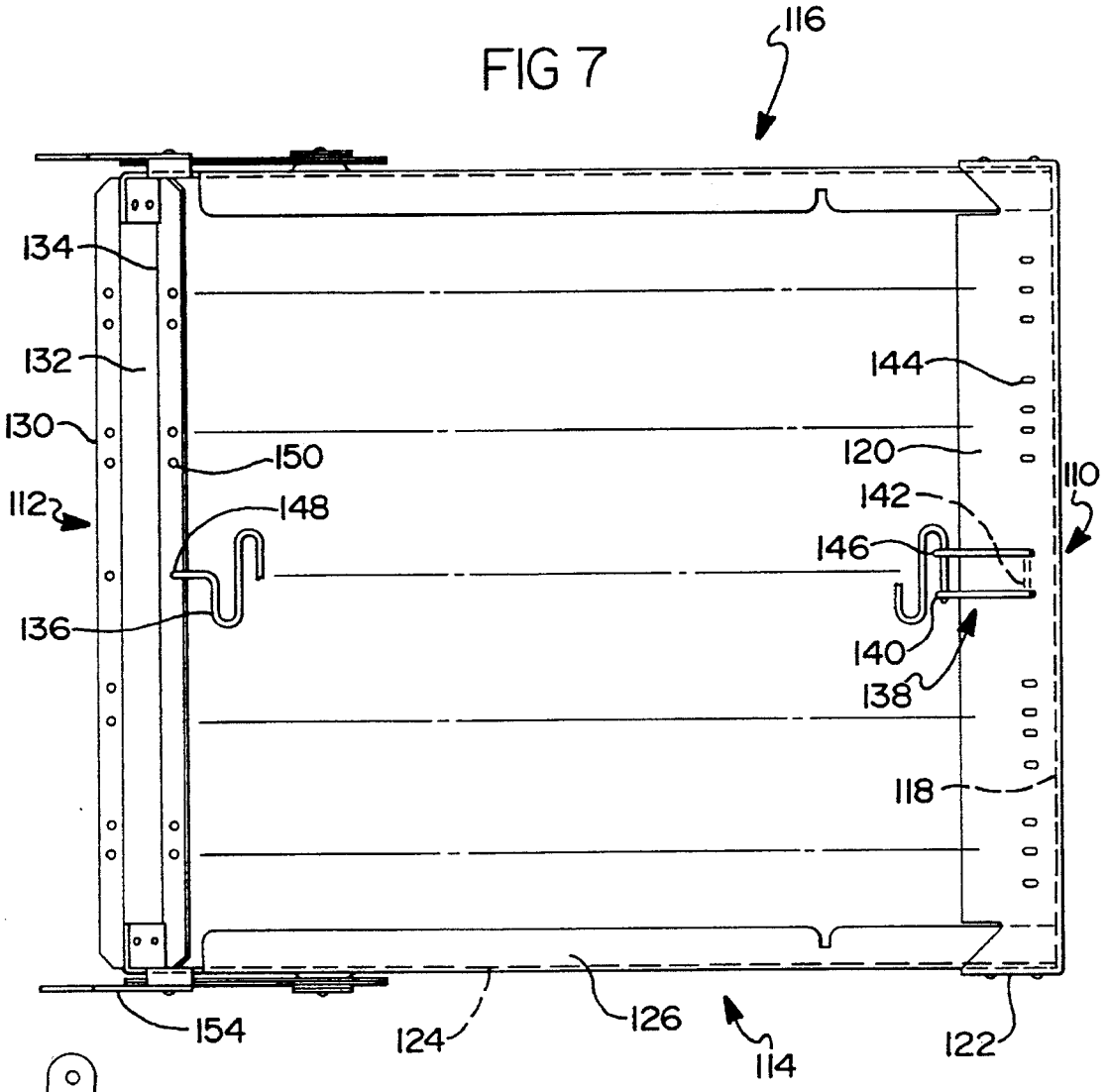
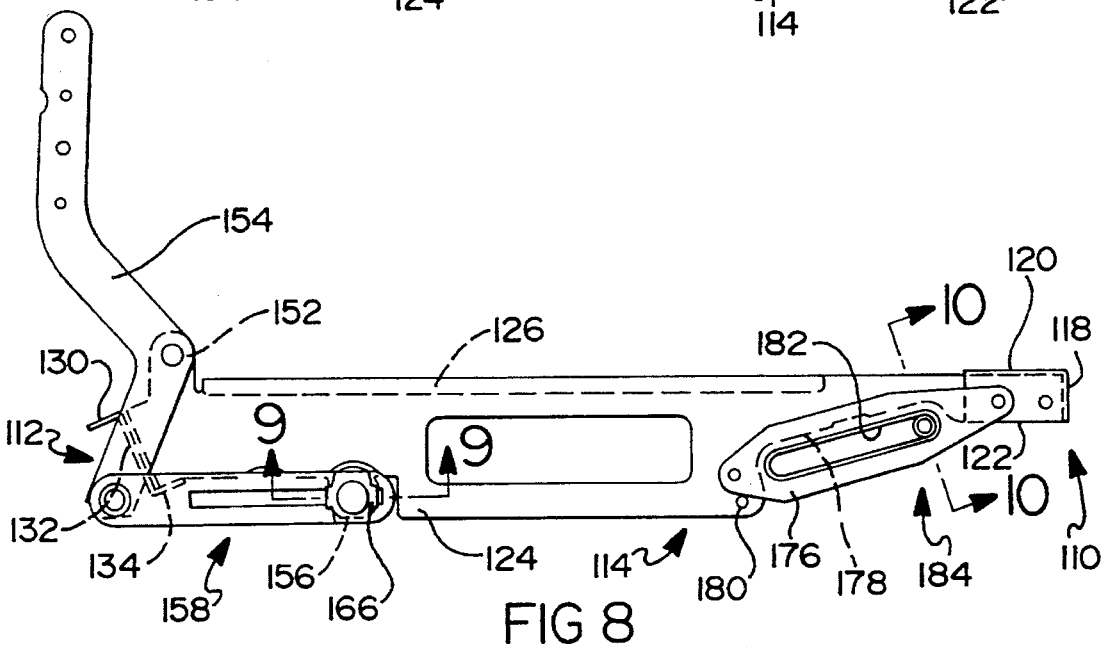
FIG 8

FIG 10
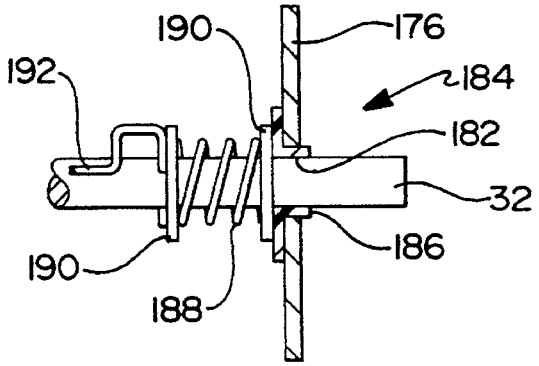
FIG 9
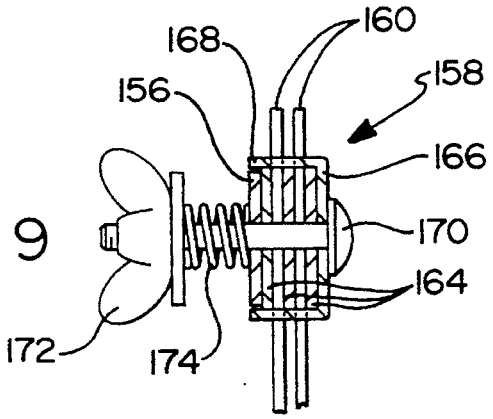
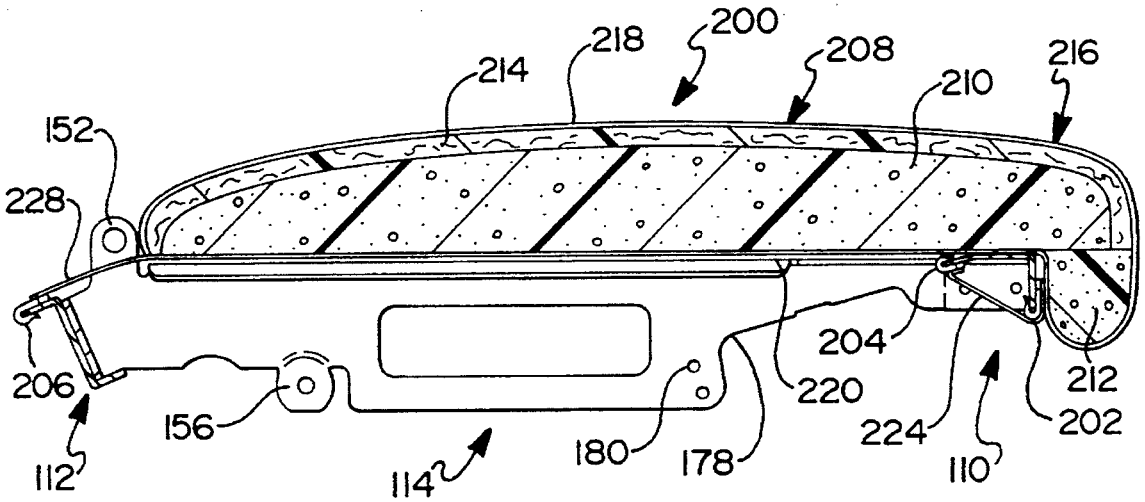
FIG 11

RECLINER CHAIR SEAT ASSEMBLY AND METHOD OF UPHOLSTERING

CROSS REFERENCE TO RELATED APPLICATIONS

The present application is a continuation-in-part of U.S. patent application Ser. No. 08/101,515 filed on Aug. 9, 1993, which is a continuation-in-part of U.S. patent application Ser. No. 08/100,916 filed on Aug. 9, 1993, now U.S. Pat. No. 5,435,621.

BACKGROUND OF THE INVENTION

1. Field of the Invention

The present invention relates generally to reclining chairs and, more particularly, to a seat assembly for use in a reclining chair constructed from pre-assembled modular components and method of upholstering same.

2. Description of Related Art

Recently, an improved method for assembling an article of furniture has been developed which overcomes the disadvantages traditionally associated with fabricating, assembling and upholstering reclining-type chairs. The improved design incorporates an integrated or "knock-down" construction of the reclining chair facilitating application of unique fabrication and assembly techniques which effectively result in increased production efficiency and cost savings while concomitantly producing a high-quality article of furniture. In general, the construction of the reclining chair is such that the pre-assembled actuation mechanism cannot be divorced from the pre-upholstered frame components which, when assembled, are rigidly interconnected to define a "box-like" chair frame or body from which the pre-assembled actuation mechanism is integrally suspended. In this manner, the conventional construction of supporting the actuation mechanism within a separate and distinct mechanism frame assembly is no longer required. The pre-assembled actuation mechanism includes a drive rod and a front support shaft which are each directly supported between left and right upholstered side frame assemblies. As such, extremely precise alignment of the actuation mechanism with respect to each of the separate upholstered side frame assemblies is possible. Moreover, unique front and rear frame rail members interconnect the left and right side frame assemblies to define a "unitized" and extremely rigid box-like chair frame or body for inhibiting side-to-side flexion of the actuation mechanism suspended therein as well as of the side frame assemblies themselves. In addition to the structural and functional advantages associated with the modular reclining chair of the present invention, a unique method of assembling the pre-assembled actuation mechanism as an integrated component within the frame components is disclosed.

Also included is a leg rest assembly may be operated by the seat occupant rotating an actuator lever through a limited angle which, in turn, rotates the drive rod for selectively extending or retracting a pair of leg rest pantograph linkages. The pantograph linkages are uniquely suspended for synchronous actuation between the drive rod and the front support shaft and protrude through apertures provided in the front frame rail member. In addition, an over-centered toggle mechanism is provided to assist in extending and retracting the leg rest assembly and in retaining the leg rest assembly in its "extended" and "stowed" positions.

The foregoing reclining chair design and method of making is the subject of U.S. Pat. Nos. 5,222,286 issued Jun. 29, 1993; 5,288,126 issued Feb. 22, 1994; 5,301,413 issued Apr. 12, 1994; and 5,323,526 issued Jun. 28, 1994; and U.S. patent application Ser. Nos. 07/913,823, filed Jul. 16, 1992; and 08/040,005 filed Apr. 9, 1993, all of which are commonly assigned to the assignee of the present invention and all of which are hereby expressly incorporated herein by reference.

SUMMARY OF THE INVENTION

In accordance with the principles of the present invention, an improved recliner chair seat assembly and method of upholstering is disclosed which is designed to be readily incorporated into the modular recliner-type chairs heretofore described. As a primary object of the present invention, an improved seat assembly for a reclining chair which may be positioned lower with respect to the reclining chair actuation mechanism is provided. The improved seat assembly can further be simply, efficiently, and rigidly assembled so as to significantly reduce its overall complexity, weight, and cost while providing improved operation and comfort.

It is an additional object of the present invention to provide swing linkage means which is adapted to permit selective and independent "reclining" movement of a seat back relative to an improved seat member as well as to provide actuation (i.e. protracting and retracting) of a leg rest assembly. The swing linkage means is selective positionable with respect to the seat assembly to vary the amount of vertical displacement of the seat assembly in connection with the "reclining" movement. As such, the present invention provides a reclining chair wherein the minimal force achieved via shifting the weight of the seat occupant is utilized as the primary means for moving the seat assembly between an "upright" position and a "reclined" position.

It is a further object of the present invention to provide a rocking/reclining chair having a front support shaft for connecting the side frame assemblies of the chair to form a rigid box-like frame, for supporting the leg rest pantograph assembly, for supporting the ratchet sector which selectively inhibits rocking movement of the chair and for supporting the seat assembly such that the seat assembly may be positioned lower with respect to the rocking/reclining chair actuation mechanism.

It is still another object of the present invention to provide a unique seat cushion which is secured to the seat frame without staples and therefore can be repeatedly installed and removed without affecting the fit and look of the cushion. This unique seat cushion, when used in connection with the simplified recliner chair and seat frame, facilitates upholstering of the chair.

It is yet a further object of the present invention to provide a front fabric facia which is secured to the front frame member of the chair without staples or other similar fasteners and therefore can be easily and repeatedly installed and removed. Thus, the new front fabric facia, when used in connection with the simplified recliner chair frame, also facilitates upholstering of the chair.

Additional objects, advantages, and features of the present invention will become apparent from the following description and appended claims, taken in conjunction with the accompanying drawings.

DESCRIPTION OF THE DRAWINGS

FIGS. 1A through 1D are perspective views of an exemplary reclining chair apparatus shown in various operative positions, the "modular" components of which have been fabricated and assembled in accordance with the principles of the present invention;

FIG. 5 is a sectional view taken along line 5—5 of FIG. 4 having an installed upholstered front center panel adapted to be releasably secured to the front cross member;

FIG. 6 is a sectional view taken along line 6—6 of FIG. 4 having an installed upholstered front end panel adapted to be releasably secured to the front cross member;

FIG. 7 is a partial top view of the seat assembly shown in FIGS. 2 and 3;

FIG. 8 is a partial side view of the seat assembly shown in FIGS. 2 and 3;

FIG. 9 is a partial sectional view taken along line 9—9 of FIG. 8 illustrating the rear attachment of the seat frame to the chair frame;

FIG. 10 is a partial sectional view taken along line 10—10 of FIG. 8 illustrating the front attachment of the seat frame to the chair frame;

FIG. 11 is a partial sectional view showing an installed upholstered seat cushion adapted to be releasably secured to the seat frame of the present invention.

DETAILED DESCRIPTION OF THE INVENTION

Figure 2:
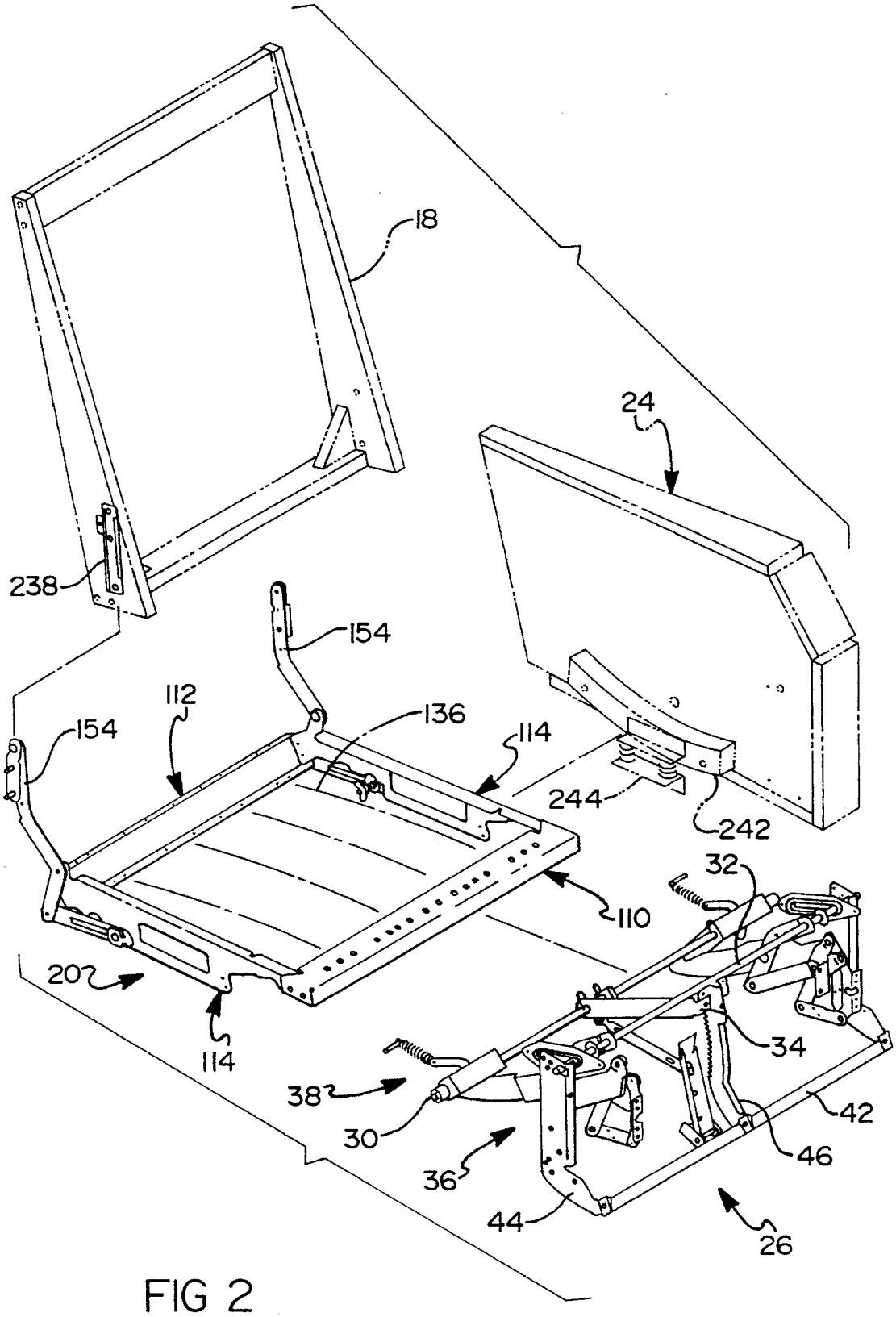
FIG. 2 is an exploded front perspective view of a reclining chair of the type shown in FIG. 1 with upholstery, springs and other parts removed from the frame components for illustrating their integrated and interdependent association with an improved seat frame construction.

In accordance with the teachings of the present invention, an improved seat frame construction for use in single and multi-person articles of furniture (i.e. chairs and sofas or loveseats) is disclosed. In addition, the present invention is also directed to a method of assembling and upholstering the improved seat frame construction as a pre-assembled and "integrated" component of a reclining-type chair or the like. As will be described, the pre-assembled seat frame is adapted to be positioned lower with respect to the reclining chair actuation mechanism, and likewise, with respect to the chair base and the floor. In a preferred embodiment, the seat frame is assembled from metal frame members prior to integration into a finished assembled reclining chair. Such construction allows for interconnecting the seat frame to the actuation mechanism along a vertical surface of the seat frame side members thereby allowing the seat frame to be lower in a finished chair.

In the disclosed embodiment, the article of furniture is shown as a combination recliner and platform rocker, hereinafter referred to reclining/rocking chair 10, which includes a pre-assembled actuation mechanism 12 and various upholstered frame components that can be quickly and simply assembled in a modular fashion as a seating unit. Such "modular" construction provides a significant advancement over conventional furniture fabrication and assembly techniques since manipulation of heavy and cumbersome chair frames during upholstery installation is no longer required. As such, the frame components can be upholstered prior to modular assembly to actuation mechanism 12 so as to improve individual component quality as well as overall system quality and production efficiency. In addition, selected frame components, such as the front cross member, seat frame and seat back, can be adapted to accept upholstered trim panels following modular assembly. For example, a seat cushion and an upholstered front trim panel can be adapted to releaseably attached to chair 10 after assembly thereof as will be further described herein. Moreover, since the seat frame 20 may be positioned lower with respect to the actuation mechanism 12, recliner chair occupants of varying height will find the chair more comfortable and larger removable upholstered cushions may be used.

With particular reference now to the drawings, the functional and structural aspects of actuation mechanism 12, shown operably suspended from the frame components of recliner/rocker chair 10, will now be described. More particularly, FIG. 1A depicts an exemplary combination reclining/rocking chair 10 having its seat assembly 14 shown in a fully "upright" position for permitting a seat occupant to enjoy conventional seating. FIG. 1B illustrates reclining/rocking chair 10 in the "upright" position with its associated leg rest assembly 16 shown protracted to its "extended" position. As seen in FIG. 1C, seat assembly 14 includes a seat back 18 shown in a "reclined" position relative to a seat frame 20 while leg rest assembly 16 is positioned in its retracted or "stowed" position. As is known, reclining movement of seat assembly 14 is accomplished by the seat occupant deliberately applying pressure to seat back 18 such that a seat swing mechanism causes seat frame 20 to move forwardly and vertically upward for maintaining seating comfort while the included angle increases therebetween. Chair 10 may be easily returned to its "upright" position upon deliberate application of rearward pressure to seat assembly 14 or, more simply, if the seat occupant leans forward to remove pressure from seat back 18. Finally, FIG. 1D shows seat assembly 14 of chair 10 in the "reclined" position with its respective leg rest assembly 16 protracted to the "extended" position. In accordance with the embodiment shown, and as will be described from the following disclosure, the entire chair 10 can be easily "rocked" with respect to stationary base assembly 22. While the present invention is shown in conjunction with a reclining/rocking chair as heretofore described, it should be generally understood that the simplified seat assembly, upholstery cushions and fabric facias further detailed hereafter may be incorporated into a variety of recliner-type chairs, motion sofa units and the like.

In accordance with a primary design feature of the present invention, the various pre-assembled frame components which provide for operably suspending actuation mechanism 12 within reclining/rocking chair 10 will now be clearly described. For purposes of clarity, FIG. 2 shows the various pre-assembled frame components with their upholstery, padding, springs, etc. removed to better illustrate the interdependency of the frame components construction which can be rapidly and rigidly assembled in a relative easy and efficient manner. Therefore, most if not all of the frame components can be individually fabricated or sub-assembled to include the requisite brackets, springs, padding and upholstery on an "off-line" batch-type basis. Thereafter, the various pre-assembled frame components are modularly assembled for totally integrating actuation mechanism 12 therein.

As seen in FIGS. 2 through 8, actuation mechanism 12 of reclining/rocking chair 10 is integrated into and operably suspended from left and right side frame assemblies 24. In addition to side frame assemblies 24, reclining/rocking chair 10 also includes front and rear frame rail members 26 and 28, respectively, which when interconnected define a rigid "box-like" chair frame. Actuation mechanism 12 is pre-assembled to include a drive rod 30 and front support shaft 32, both of which are spatially oriented to be precisely located and "suspended" from left and right side frame assemblies 24. A rigid cross-brace 34 is secured between drive rod 30 and support shaft 32 for providing structural rigidity within actuation mechanism 12. Leg rest assembly 16 is suspended from actuation mechanism 12 for permitting the seat occupant to selectively actuate leg rest assembly 16.

As best seen in FIG. 2, most of the structural frame components such as side frame assemblies 24, front frame rail member or assembly 26, seat frame 20, seat back frame 18 and leg rest frame board 40 are each fabricated and/or constructed in a manner which enables them to support springs, padding, upholstery, etc. in order to complete a decorative and stylish reclining/rocking chair 10 similar to that shown in FIGS. 1A through 1D.

Figure 4:
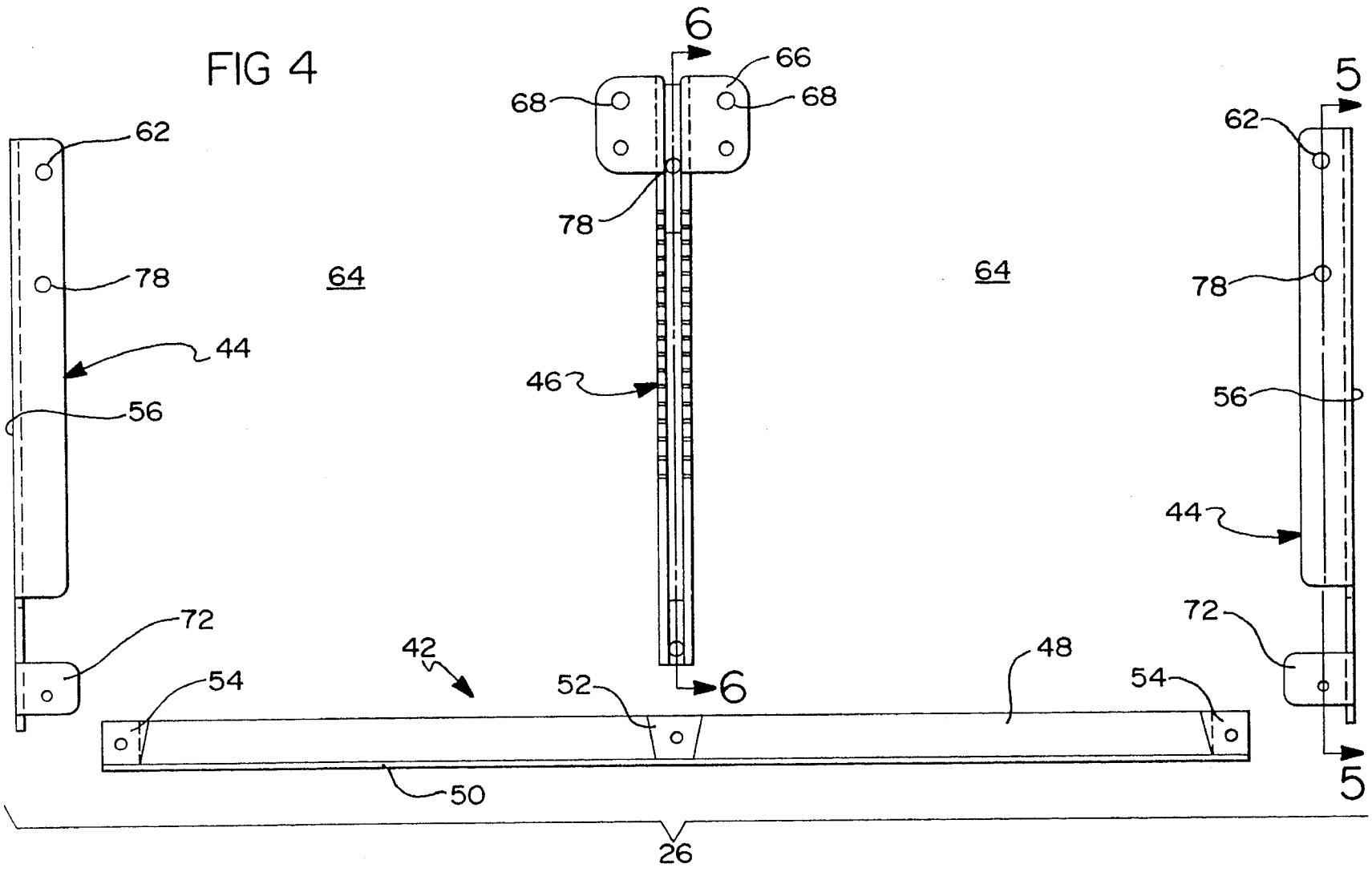
FIG. 4 is an exploded view of the front frame rail assembly shown in FIGS. 2 and 3.

With reference now to FIGS. 4–6, reclining chair 10, in a presently preferred embodiment, includes front frame rail 26 assembly as shown. As can be seen from FIG. 4, front frame rail assembly 26 is a multi-piece assembly including lower cross-member segment 42, end member segments 44 extending upwardly from opposite lateral ends of cross-member segment 42 and which are substantially parallel to, but laterally displaced from, cross-member segment 42. Central segment 46 is also provided and secured substantially midway between end member segments 44. In a presently preferred embodiment, central segment 46 is a ratchet sector used in conjunction with a pawl mechanism to provide additional comfort features as will be described hereinafter. Lower cross-member segment 42 is generally L-shaped in cross section having vertical flange 48 and horizontal flange 50. Recess 52 is formed in the middle of lower cross-member segment 42 for receiving central segment 46 by locally bending vertical flange 48 rearward and slightly off vertical. Recess 54, similar to recess 52, is formed at each end of lower cross-member segment 42 for receiving end member segments 44. The orientation of recess 52 and central segment 46 and recess 54 and end member segments 44 facilitate the alignment and assembly of front frame rail assembly 26. Central segment 46 and end member segments 44 are rigidly secured to lower cross-member segment 42 by, for example, threaded fasteners 47. It should be understood, however, that any suitable means for fastening, such as by welding, riveting, or the like, may be used to secure the front frame rail assembly 26 together.

End member segments 44 are formed with an outer flanged bracket segment 56 which extends transversely from each end segment 44 and includes a series of bores 50 which are alignable with a series of bores (not shown) formed in side frame assemblies 24 for rigidly securing front frame rail assembly 26 between side frame assemblies 24. In addition, each flanged bracket segment 56 also includes a guide slot 60 for retaining and locating opposite end portions of support shaft 32 thereon. As noted, the front face of each end segment 44 is generally parallel to but laterally displaced from lower cross-member segment 42 and includes a bore 62 which is aligned in a common horizontal plane with guide slots 60. Bores 62 are provided for fixing end segments 44 of front frame rail assembly 26 to end portions of support shaft 32.

Central segment 46 cooperates with the laterally-spaced end segments 44 for defining a pair of enlarged open-ended apertures 64 for permitting extension and retraction of leg rest assembly 16. A set of four bores 68 are formed in top segment 66 for fixing central segment 46 of front frame rail assembly 26 to a central portion of support shaft 32 and cross-brace 34.

Accordingly, support shaft 32 is preferably pre-drilled with four bores which are alignable with bores 62 and 68 formed in end member segments 44 and central segment 46, respectively, for receiving threaded fasteners 47 therein to rigidly secure support shaft 32 directly to front frame rail assembly 26. Similarly, cross brace 34 is secured to central segment 46 with threaded fastener 47. Thus, eight threaded fasteners—three across lower cross member segment 42, four across support shaft 32 and one in cross brace 34, are used to assembly front cross member 26 into a rigid, rectangular assembly. As such, support shaft 32 is non-rotatably fixed to front frame rail assembly 26 and acts as an upper cross-member for providing superior rigidity to the front portion of chair 10. As can be further appreciated, forming lower cross-member segment 42, end members segments 44 and central segment 46 as separate pieces greatly reduces the complexity of the metal forming dies and simplifies the assembly operations such that overall cost is reduced while quality of the reclining chair is enhanced. An additional benefit of the front frame rail assembly 26 is that the lower cross-member 42 may now be displaced laterally from end member segments 44 and central segment 46 for providing additional clearance for leg rest assembly 16.

As best seen in FIG. 6, end member segments 44 are formed with a forward extending flange 70 onto which mounting tab 72 is formed at its forward end. Similarly, as seen in FIG. 5, central segment 46 is formed with a forward extending flange 74 onto which mounting surface 76 is formed at its forward end. Thus, the exterior surface of lower cross-member segment 42 in a completed front frame rail assembly 26 is displaced laterally from end member segments 44 and central segment 46 while still maintaining a substantially parallel relationship thereto. Such a displaced mounting arrangement of lower cross-member segment 42 provides for maintaining the compact nature of the chair of the present invention as compared to conventional chairs while providing additional clearance between the chair frame and the leg rest frame board 40 for accommodating such features as a "pop-up" ottoman frame board (not shown) if the leg rest member is so equipped. For an example of such features, see U.S. patent application Ser. No. 08/319,671, entitled "Dual Leg Rest Assembly" filed on Oct. 12, 1994 and commonly owned by the assignee of the present invention. Such additional clearance space can be seen in FIGS. 4 and 5 which clearly illustrates the displaced position of lower cross-member segment 42 with respect to central segment 46 and end member segments 44. End member segments 44 and lower cross-member segment 42 are each formed with a plurality of apertures 78 for receiving push-in retainers for mounting front tailgate 80 to front frame rail assembly 26 as will be further described hereinafter.

The reclining chair of the present invention further includes a three-piece front tailgate or fabric facia 80 for upholstering front cross-member segment 42, end member segments 44 and central segment 46 while providing clearance for pantograph linkage mechanism 36. Referring now to FIG. 5, front center facia 82 is secured to front cross-member segment 42 and central segment 46. Front center facia 82 includes outer fabric layer 84 secured to backing board 86 for providing shape and rigidity to front center facia 82. While there are a variety of means for securing the fabric layer 84 to backing board 86, it is presently preferred to utilize a suitable adhesive.

J-strip 88 is secured to the lower edge of front center facia 82. In general, J-strip 88 has a leg portion 90 which provides a surface for attaching J-strip 88 to facia 82 typically by stitching the strip to the fabric layer 84. Hook portion 92 is formed in J-strip 88 and is adapted to engage a metal flange. For example, J-strip 88 can be releasably positioned to engage lower horizontal flange 50 for attaching front center facia 82 to front cross member segment 42. Fastener 94 is disposed in the upper portion of front center facia 82 and extends through fabric layer 84 and backing board 86. After J-strip 88 is secured to front cross-member segment 42, fastener 94 is inserted into aperture 78 disposed through central segment 4 for securing front center facia 82 in place.

Figure 3:
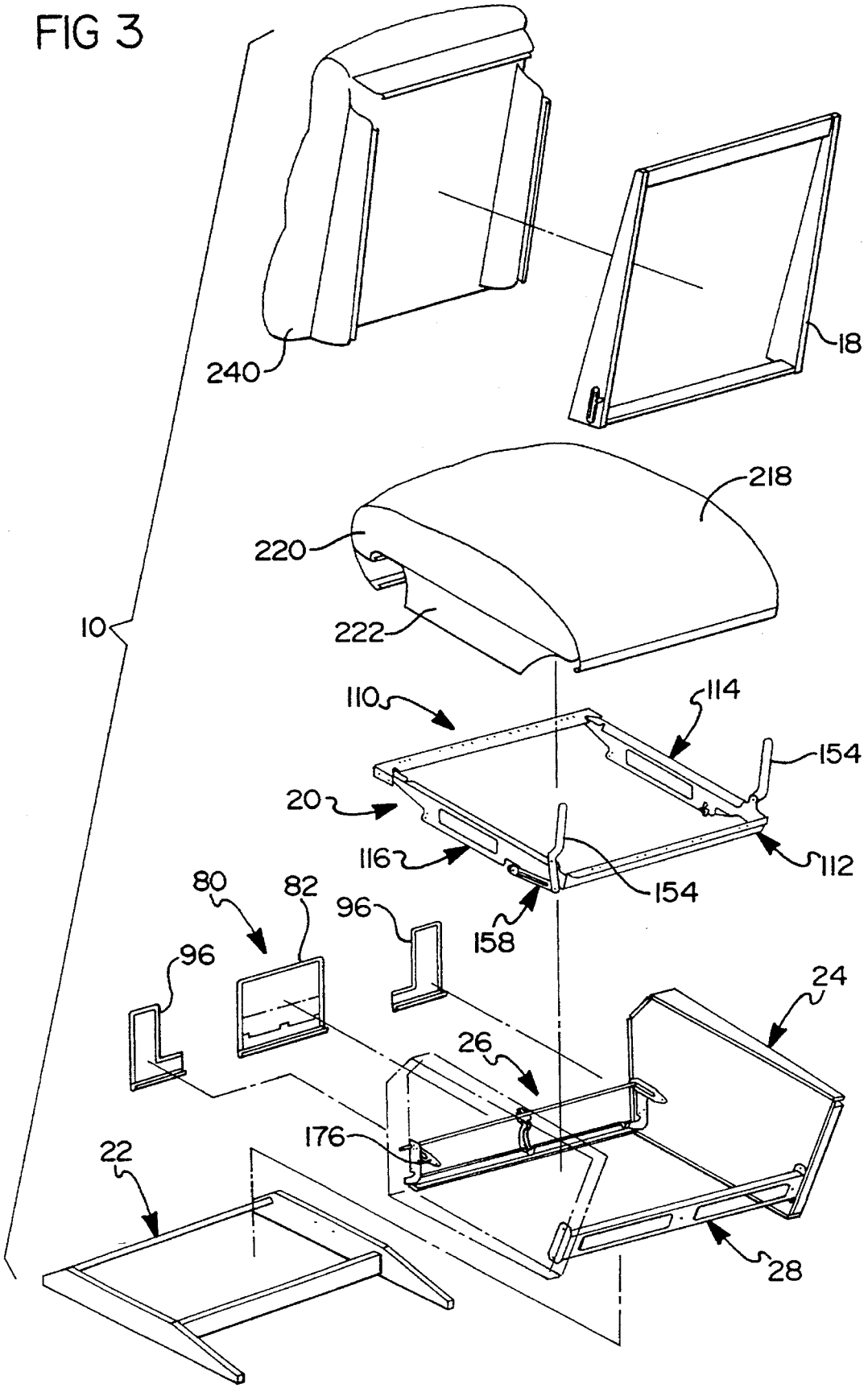
FIG. 3 is an opposite perspective view of the reclining chair shown in FIG. 2 with the deletion of the pantograph leg rest, and other actuation components, and the addition of upholstery cushions for the seat frame and seat back.

Referring now to FIGS. 3 and 6, front end facia 96 includes fabric layer 98 and backing board 100. Front end facia 96 is secured to lower cross-member segment 42 and end member 44 in a manner similar to that heretofore describe in conjunction with front center facia 82 incorporating J-strip 102 and fastener 104.

With reference to the FIGS. 2, 3 and 11, a seat frame is illustrated which affords greater adaptability of features for the present invention. For example, seat frame 20 may be configured with differing numbers of seat springs without requiring different components. Similarly, the geometry of the reclining mechanism can be altered to vary the amount of tilting associated with the reclining feature of the chair.

Referring now to FIGS. 7 and 8, seat frame 20 includes front cross rail 110 and rear cross rail 112 transversely located by a pair of laterally-spaced (i.e., right and left) side bars 114, 116 which are symmetrical opposites of each other. Front cross rail 110 is generally L-shaped in cross section having vertical front flange 118, top flange 120 and a pair of end flanges 122 extending parallel to side bars 114, 116 for securing side bars 114 and 116 thereto. The rearward edge of top flange 120 is bent slightly downward for a securing cushion to seat frame 20 as can best be seen in FIG. 19 and which will be described hereafter.

Side rails 114, 116 are also generally L-shaped in cross section having vertical side flange 124 and top flange 126 which extends generally horizontal but is bent slightly downward at its inboard edge similar to front cross rail 110. A pair of inwardly extending end flanges 128 are formed on the rear end of side rails 114, 116 for securing rear cross rail 112 thereto. Rear cross rail 112 is generally Z-shaped in cross section having upper and lower flanges 130 and 134 extending transversely and connected by web 132. Rear cross rail 112 is secured to side rail end flanges 128 such that web 132 is disposed off of the vertical axis. Front cross rail 110, rear cross rail 112 and side rails 114, 116 are adapted to be secured together with threaded fasteners to form a rigid, flat rectangular structure which permits use of loose or detachable cushions.

A plurality of sinuous seat springs 136 are disposed between front and rear cross rails 110, 112 for supporting seat cushion 200. U-shaped spring clips 138 secure seat springs 136 to front cross rail 110 and include a pair of laterally extending legs 140 connected by transverse mid portion 142. Spring clip 138 is inserted into corresponding holes 144 in front cross rail 110 such that mid portion 142 engages top flange 120 and legs 140 extend through holes 144 towards rear cross rail 112. Each end of spring clip 138 has a hook 146 formed therein for retaining the front end of seat spring 138. Similarly, the back end of seat spring 138 has a hook 148 formed therein which can be inserted into a corresponding hole 150 in lower flange 134 of rear cross rail 112.

As best seen in FIG. 7, front and rear cross rails 110, 112 are provided with a plurality of holes such that the number of seat springs incorporated into seat frame 20 can be modified without requiring different frame components. In this manner, the same seat frame can be utilized in different styles and lines of chairs.

With reference to FIGS. 7, 8 and 11, seat frame 20 is supported from side frame assemblies 24 and adapted for reclining movement by means of seat swing mechanism. Since left and right side rails 114, 116 are mirror images, reference will only be made to left side rail 114. Upstanding post 152 is formed in the rear portion of side rail 114. Swing link 154 is pivotally connected to upstanding post 152 for supporting the back of seat frame 20 and allowing relative motion between seat frame 20 and seat back frame 18. Side rails 114 further includes downwardly extending tab 156 for connecting rear frictional drag mechanism 158 to seat frame 20.

As best shown in FIG. 9, rear frictional drag mechanism 158 is located adjacent side rail 114 and provides means for resisting the reclining movement of seat assembly 14 in response to relative motion between seat frame 20 and seat back frame 18. On each side of seat frame 20, a pair of thin metal slide members 160 having lost-motion slot 162 are interdisposed between three nylon washers 164 which are held in place by retainer 166 and threaded fastener 170 which pinch slide members 160 together. Retainer 166 includes a pair of tabs 168 which extend through slots 162 of slide member 160 for properly orienting slide members 160. Further, spring 174 is concentrically located on fastener 170 for clamping slide members 160 between retainer 166 and frame tab 156. The friction generated by rear frictional drag mechanism 158 can be adjusted with adjusting nut 172 which increases or decreases the preload in compression spring 174.

Referring again to FIGS. 8 and 10, the front portion of seat frame 20 is supported from side frame assemblies 24 by support shaft 32. Side rail 114 is adapted to receive a pair of front slide brackets 176. In the presently preferred embodiment front slide brackets 176 are secured to side rails 114 with threaded fasteners. Side rails 114 each have notched portion 178 formed therein for providing clearance to allow seat frame 20 to move relative to support shaft 32 as it travels through the range of reclining motion. This additional clearance enables seat frame 20 to be positioned lower with respect to actuation mechanism 12. The forward attachment point is common with the fasteners used to secure side rail 114 with front cross rail 110. A plurality of apertures 180 are formed in side rail 114 to provide a rearward attachment point for front slide bracket 176. Apertures 180 enable front slide bracket 176 to be positioned in more than one orientation. In this way, seat frame 20 can be customized to provide varying degrees of vertical movement in conjunction with the associated horizontal movement during reclining.

As previously described, front slide bracket 176 includes lost motion slot 182 for guiding and limiting the fore/aft motion of seat frame 20 on support shaft 32. Front slide bracket 176 further includes front frictional drag mechanism 184. As best seen in FIG. 10, front frictional drag mechanism 184 includes nylon insert 86 disposed within lost-motion slot 182. Compression spring 188 is concentrically located on support shaft 32, surrounded by a pair of washer 190 and transversely positioned by spacer clip 192 to fixedly retain nylon insert in front slide bracket 176 and to center the seat assembly in support shaft 32. If one or both of the seat assembly side rails are tapered, as opposed to being straight, when, for example, the seating unit is incorporated next to other modular units in a sofa or the like, the amount of spacing between the seat assembly and the side frame assemblies 24 may vary.

The reclining chair of the present invention further includes a seat cushion 200 specifically designed for use with metal seat frame 20 with simplifies the steps necessary for upholstering a reclining chair. With reference now to FIGS. 3 and 11, seat cushion 200 of the present invention will now be described. Seat cushion 200 is adapted to be placed directly on top of seat springs 136 and includes integral attachment strips 202, 204 and 206 which engage portions of seat frame 20 for retaining seat cushion 200 thereto.

The shape of seat cushion 200 is generally defined by foam cushion 208 having a knee bolster located along the front edge and tapered rear portion located along the rear edge. In the presently preferred embodiment, foam cushion 208 is constructed from two-pieces of suitable foam adhesively bonded together—an upper blank 210 which includes the seat and a lower portion 212 which forms a knee bolster.

Seat cushion 200 further includes contour layer 214 disposed on top of cushion 208 and the wrapping around knee bolster 212 for providing a smooth surface with a "stuffed" look. Thermofil® foam or other suitable material may be used for contour layer 214. Outer upholstery fabric layer 216 includes top panel 218 and side panels 220 (FIG. 3) for covering the exposed surfaces of seat cushion 200. Side panels 220 further include wing portions 222 which can be tucked in between seat frame 20 and side frame assemblies 24 to provide a continuous upholstered look. Liner portions 224, 226 and 228 are stitched to the ends of fabric layer 216 and substantially cover the unexposed surfaces of foam cushion 208 including the portions which abut seat frame 20 to prevent seat springs 136 from abrading foam cushion 208. A tear resistant material may be is utilized for the liner.

Seat cushion 200 is releasably attached to seat frame 20 by a plurality of plastic J-strips, including front inner J-strip 202, front outer J-strip 204 and rear J-strip 206. These J-strips are similar to those described in conjunction with fabric facias heretofore discussed. Front inner J-strip is disposed on cushion 208 behind knee bolster 212 and engages vertical front flange 118. Similarly, front outer J-strip 204 is stitched to liner 224 along the front transverse edge of seat cushion 200 and grasps horizontal top flange 120 of front cross rail 110. Thus, a smooth attachment is achieved by utilizing two attachment strips along the front of cushion 200. Rear J-strip 206 is stitched to liner 228 along the rear transverse edge of seat cushion 200 and grasps upper flange 130 of rear cross rail 112.

The dimensions of fabric layer 216 are such that foam cushion 208 must be slightly compressed to appropriately position J-strips 202, 204, and 206 over their respective flanges. When released, the expansion of foam cushion 208 causes J-strips 202, 204, and 206 to be pulled tight against their respective flanges. Furthermore, the expansion of foam cushion 208 acts to pull fabric layer 216 taunt on seat cushion 200 and give the cushion an aesthetically pleasing appearance.

Referring again to FIGS. 2 and 3, seat back 18 is in the form of a rigid relatively rectangular assembly. Seat back frame 18 includes right and left hand side members 230, 232 and upper and lower cross-pieces 234, 236, respectively. As is known, seat back frame 18 can be removably mounted on an upper portion of rear swing links 154 by means of slide brackets 238 secured at suitable locations on side members 230, 232. A preferred construction of slide brackets 238 for this type of mounting is shown and described in U.S. Pat. No. 5,184,871, assigned to the common assignee of the present invention, the disclosure of which is expressly incorporated by reference herein. Seat back frame 18 could be readily adapted to secure back cushion 240 in a manner similar to seat cushion 200. For example, seat back frame 18 could be fabricated from metal frame components similar to seat assembly 20 of the present invention and back cushion 240 could be constructed (as shown) for ease of attachment like seat cushion 200.

Leg rest assembly 16 is shown to include leg rest frame board 40 having an outer surface that is padded and upholstered so that finished reclining/rocking chair 10 will be as seen in FIGS. 1A through 1D. Frame board 40 is supported and moved by identical left and right hand pantograph linkages 36. Left and right spring-assist toggle assemblies 38 are provided which work coactively with leg rest pantograph linkages 36. Toggle assemblies 38 provide means for securely holding frame board 40 of leg rest assembly 16 in a fully retracted position. Toggle assemblies 38 are also operable to supply a spring force for biasingly urging leg rest assembly 16 toward one of its extended and retracted positions. Pantograph linkages 36 and toggle assemblies 38 may be similar in function and structure to that shown in FIG. 3 of U.S. Pat. No. 3,096,121, assigned to the common Assignee of the present invention, with the exception that pantograph linkages 36 are operably suspended about the second set of "fixed" suspension points defined by support shaft 32. Alternatively, pantograph linkages 36 and toggle assemblies 38 may be similar in function and structure to that shown in U.S. patent application Ser. No. 08/322,789 entitled "Pawl And Ratchet Assembly" filed on Oct. 13, 1994 and commonly owned by the assignee of the present invention. Reference may be made to the above-identified patent and application, which are expressly incorporated herein.

To provide means for permitting the chair frame 10 to rock relative to base assembly 22, contoured rocker blocks 242 are provided which are secured to side frame assemblies 24. Rocker blocks 242 are positioned to engage an upper surface of base assembly 22 in a "rockable" relation therewith. Rocker blocks 242 and base assembly 22 are interconnected by a double coil spring "rocker" device, generally shown at 244. As will be appreciated, rocker spring device 244 is operable to permit balanced rocking movement of chair 10 with respect to fixed base assembly 22 without causing seat assembly 14 to recline inadvertently. Preferably, rocker spring device 244 is similar to that disclosed in U.S. Pat. No. 5,171,000, commonly owned by the assignee of the present invention.

In accordance with another comfort feature associated with combination reclining/rocking chair 10, a locking apparatus 246 is provided that is operable to releasably hold chair 10 in any one of a plurality of rearwardly "tilted" positions upon leg rest assembly 16 being selectively moved to its fully extended position. Locking apparatus 246 is also operable to inhibit subsequent rocking movement of chair 10 in a forward direction following movement to a desired rearwardly "tilted" position. Preferably, locking apparatus 246 is a ratchet type locking mechanism that is actuated upon angular movement of drive rod 30. In general, pawl mechanism 248 acts between ratchet sector 46 and base assembly 22 for providing a number of sequential lockable rearwardly "tilted" positions. Presently, preferred examples of locking mechanisms are thoroughly shown and disclosed in U.S. Pat. No. 5,328,235 and U.S. patent application Ser. No. 08/319,671 entitled "Dual Leg Rest Assembly" filed on Oct. 12, 1994 and commonly owned by the assignee of the present invention, the disclosures of which are expressly incorporated by reference herein.

From the foregoing description, one skilled in the art will readily appreciate that the design of the present invention utilizes support shaft 32 to integrate five positioning and supporting functions of chair 10. The front portion of side frame assemblies 24 are located and connected by the ends of support shaft 32 and end member segments 44 attached thereto. Pantograph linkage assembly 36 is partially suspended from and supported by support shaft 32. The upper end of ratchet sector 46 of locking mechanism 246 is secured to and supported by support shaft 32. Similarly, the front portion of seat frame 20 is supported support shaft 32 via front slide brackets 176. In addition, the configuration of notched portion 178 formed in side rails 114 enable seat frame 20 to be positioned closer to support shaft 32 and thus lower relative to actuation mechanism 12. By combining these functions into support shaft 32, a chair having integrated components not heretofore found in other prior art devices is disclosed.

While a general description of the method of assembling the "modular" pre-assembled frame components will now be given, a detailed description of the method of assembling is provided in U.S. Pat. Nos. 5,222,286 issued on Jun. 29, 1993 and 5,301,413 issued Apr. 12, 1994, which have been previously incorporated by reference herein. The improved method of the present invention permits sequential assembly of the pre-assembled and/or upholstered components in a simple and efficient manner for significantly reducing overall system complexity, weight and cost while promoting superior quality and reliability.

Figure 12A:
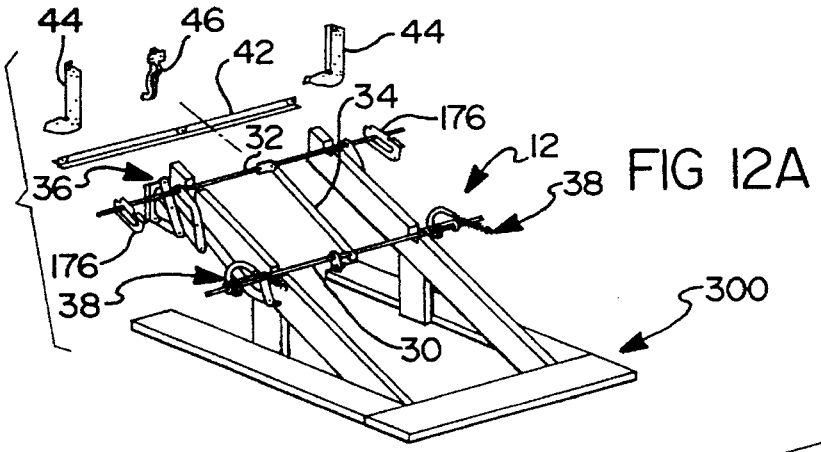
FIGS. 12A through 12H are various perspective views provided to illustrate one preferred method for assembling the reclining chair apparatus of the present invention.
Figure 12B:
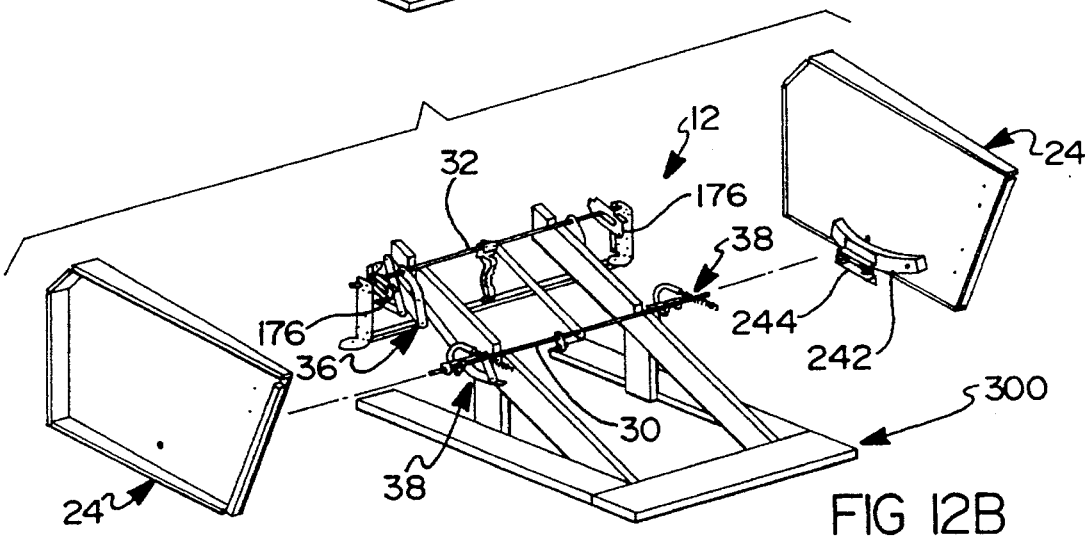
Figure 12C:
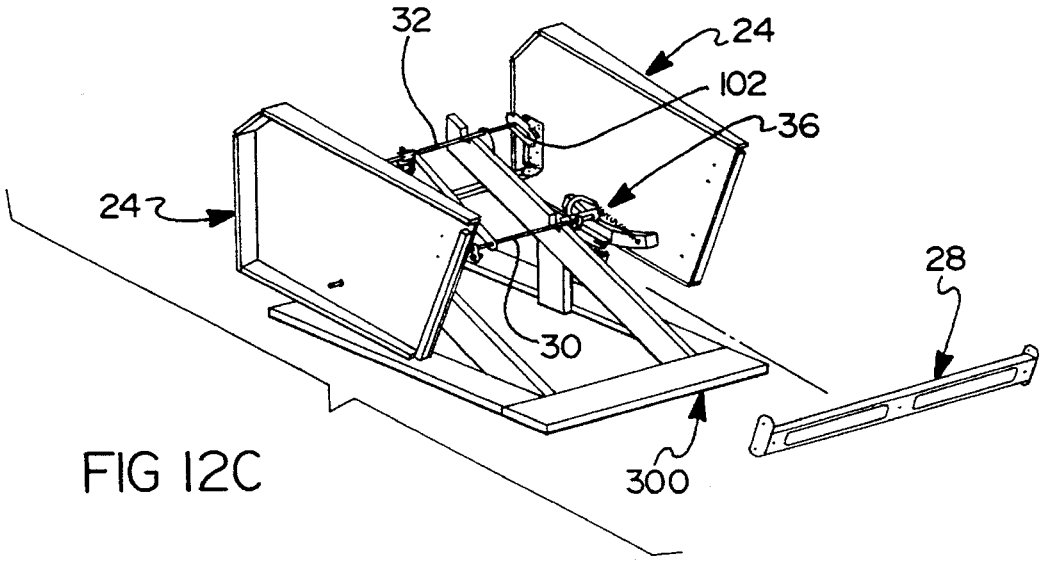
Figure 12D:
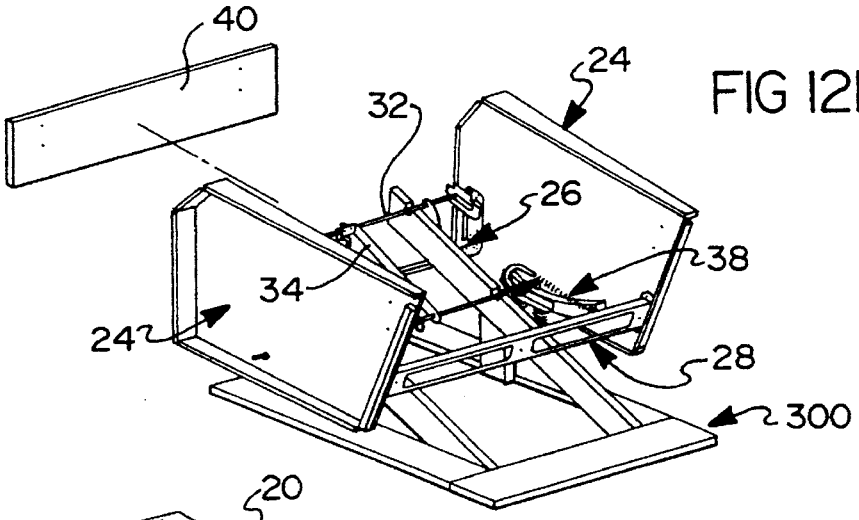
Figure 12E:
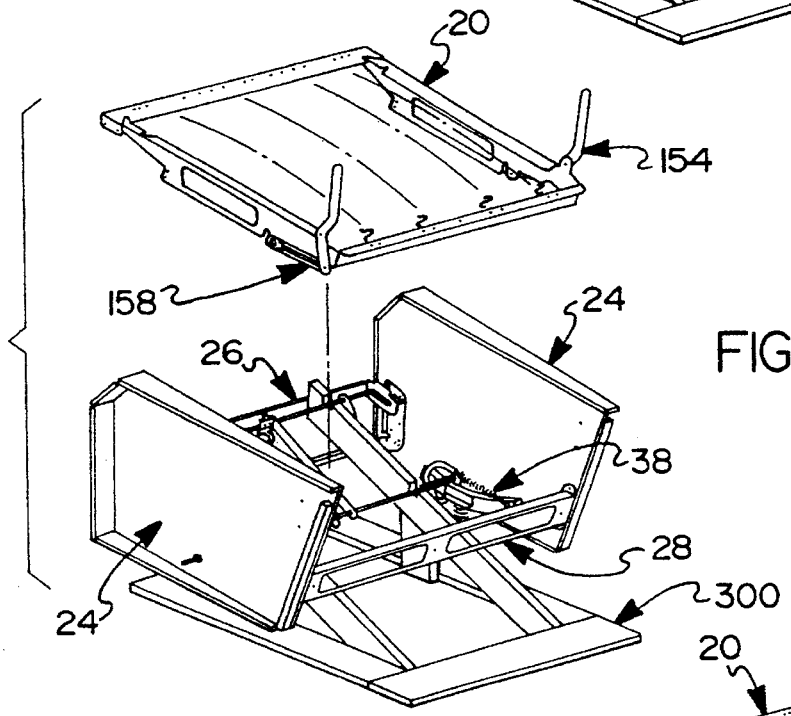
Figure 12F:
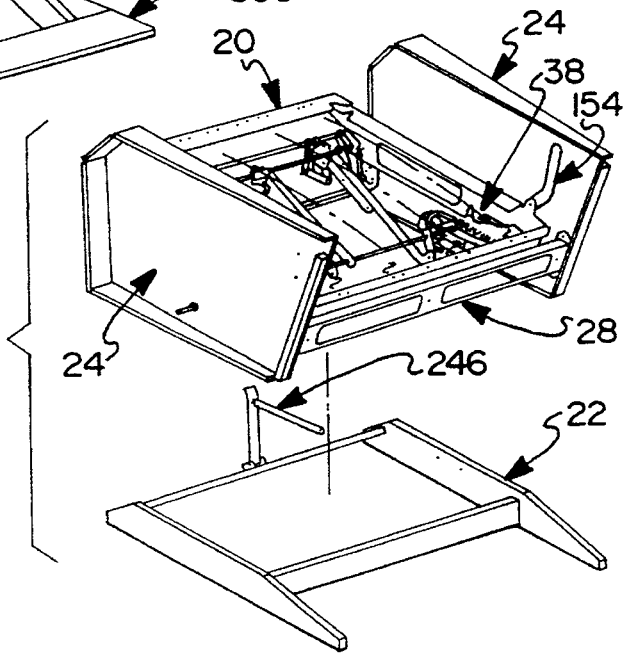
Figure 12G:
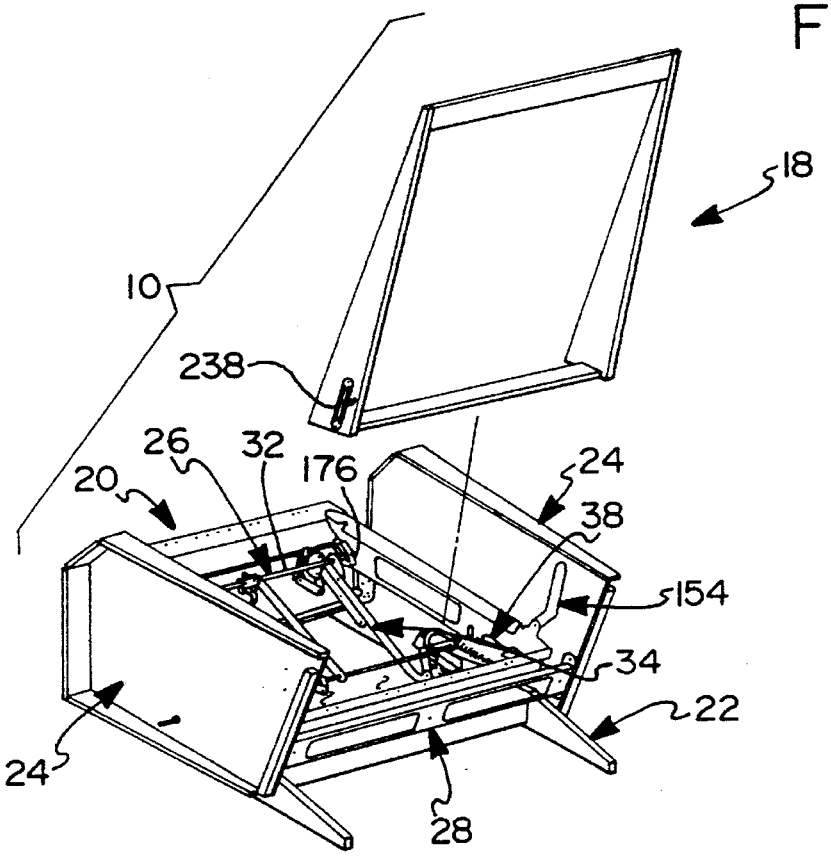
Figure 12H:
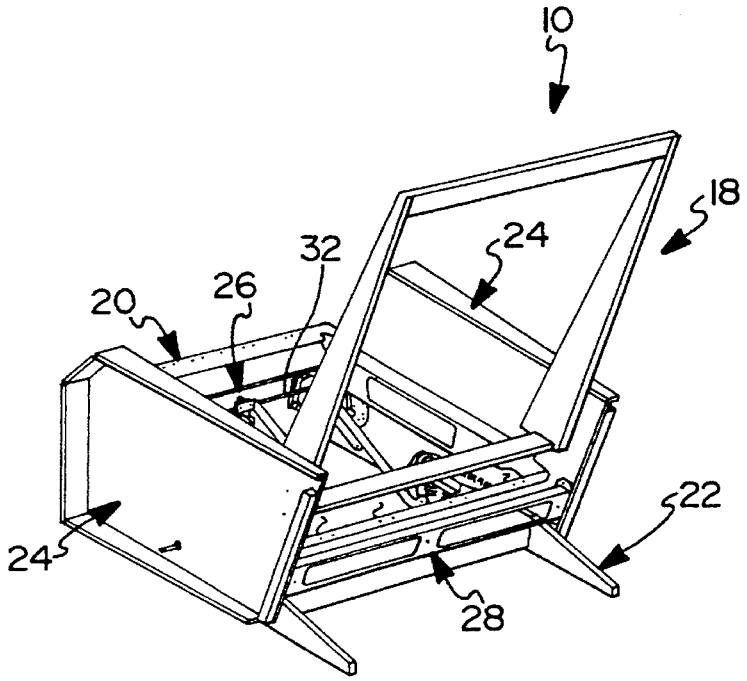

Referring now to FIGS. 12A through 12H, actuation mechanism 12 including front slide bracket 176 is disposed on support shaft 32 and located on jig 300. Front cross member assembly 26 including lower cross member segment 42, end member segments 44 and central member segment 46 are suspended from support rod 32. Jig 300 may include side portions (not shown) extending vertically from the outboard edges of base 300 to align components of front cross member assembly 26 relative to the components of actuation mechanism 12 such that lower cross member segment 42, end member segment 44 and central member segment 46 are perpindicularly situated with respect to drive rod 30 and support rod 32, while maintaining drive rod 30 and support shaft 32 in parallel alignment. Once appropriately positioned, front cross member assembly 26 is secured to support rod 32 and cross brace 34 with threaded fasteners to form a rigid, unitary assembly suspended from jig 300, as best seen in FIG. 12B.

Next, side frame assemblies 24 are appropriately positioned on actuation mechanism 12. Front frame members 26 is aligned and secured to side frame assemblies 24 with threaded fasteners at three locations per side through apertures 58 in end member segments 44. Similarly, rear frame member 28 is aligned and secured to side frame assembly 24 at two locations per side. Seat assembly 14 is appropriately positioned and secured at the front portion to front slide bracket 176 and at the rear portion to side frame assembly 24. Chair 10 is then removed from jig 300 and positioned and coupled to chair base assembly 22 to enable rocking movement thereof.

With reference to FIGS. 3 and 11 seat cushion 200 having J-strips 202, 204 and 206 is positioned onto seat frame 20. First, J-strip 202 is disposed on and engages vertical flange 118. Next, liner portion 224 of seat cushion 200 is wrapped under front frame rail 110 such that J-strip 204 engages the edge of horizontal flange 120 to secure the front edge of seat cushion 200 to seat frame 20. Finally, rear liner portion 228 is extended backward such that J-strip 206 engages upper flange 130 of rear frame rail 112 to secure the rear portion of seat cushion 200 to seat frame 20.

With reference now to FIGS. 3, 5 and 6, front fabric facia 80 is located on and secured to front frame rail 26. J-strip 102 disposed on the lower edge of center fabric facia 82 is disposed on and engages horizontal flange 50. The upper portion of center fabric facia 82 is positioned relative to ratchet sector 46. Fastener 104 is inserted through center fabric facia 82 into aperture 78 for further securing center fabric facia 82 to front frame rail segment 26. Similarly, end fabric facia 82 is located and secured to front frame rail 26. J-strip 102 disposed on the lower edge of end fabric facia 96 is disposed on and engages horizontal flange 50. The upper portion of end fabric facia 96 is positioned relative to end member segments 44. Fastener 104 is inserted through end fabric facia 96 into aperture 78 for further securing end fabric facia 96 to front frame rail 26.

Referring again to FIGS. 12A through 12H, assembly of the modular reclining chair is completed by providing seat back 18 which slidingly engages a portion of swing link means 154. As is relatively apparent from examination of the figures, the pre-assembled components can be interconnected in a number of other acceptable sequential operations to produce "knock-down" or modular chair 10. The method of assembly disclosed herein is advantageous in that virtually all of the components can be pre-assembled "off-line" for quick and efficient modular interconnection in a highly repeatable and precise fashion.

The foregoing discussion discloses and describes an exemplary embodiment of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. In a reclining chair of the type having a seat assembly interconnected to an actuation mechanism, the actuation mechanism suspended within a chair frame for permitting a fore and aft longitudinal movement of the seat assembly relative to the chair frame, the seat assembly comprising:

a seat back detachably secured to the seat assembly;

a seat frame having a pair of side frames rails connecting a front frame rail and a rear frame rail to form a substantially rectangular frame and at least one seat spring disposed within said rectangular frame for supporting a seat cushion;

swing link means for pivotally interconnecting said seat back and said seat frame to permit reclining movement of said seat assembly with respect to the chair frame between an upright position and a reclined position in response to pressure applied by a seat occupant to said seat back, said swing link means connected to the chair frame to suspend said seat assembly therebetween; and guide means for connecting said seat frame and the actuation mechanism and guiding the longitudinal movement of said seat frame in response to reclining movement of said seat assembly, said guide means including a pair of slide brackets having a lost-motion slot formed therein which are securable to a forward portion of said seat frame.

2. The reclining chair of claim 1 wherein said guide means are selectively securable to said side frame rails in a first and second position such that an angular relationship between said guide means and said seat frame can be varied thereby adjusting vertical movement of said seat frame relative to the chair frame in association with said fore and aft longitudinal movement thereof.

3. The reclining chair of claim 2 wherein said side frame rails include a vertical wall portion having a front attachment hole and at least two rear attachment holes formed therethrough and wherein said guide means is secured to said side frame rails at said front attachment hole and one of said at least two rear attachment holes by threaded fasteners.

4. The reclining chair of claim 3 wherein said guide means further comprises a nylon insert disposed within said lost motion slots.

5. The reclining chair of claim 1 wherein said at least one seat spring is disposed between said front and rear frame rails and selectively positionable at a lateral location within said seat frame.

6. The reclining chair of claim 5 further comprising:

said front frame rail having a flange with a first set of holes therethrough;

said rear frame rail having a flange with a second set of holes therethrough; and said at least one seat spring having a clip disposed on one end and extending through one of said first set of holes for attaching said at least one spring to said front frame rail and a hook formed on the opposite end and extending through one of said second set of holes for attaching said at least one spring to said rear frame rail, said first and second set of holes defining said lateral location.

7. The reclining chair of claim 1 further comprising friction means operably connected between said swing link means and said seat frame for resisting the reclining movement of said seat assembly in response to relative motion between said seat frame and said seat back.

8. The reclining chair of claim 7 wherein said friction means comprises a slide member disposed adjacent to said side frame rails, said slide member having a first portion pivotally coupled to said swing link means opposite said connection to said chair frame and a second portion coupled for sliding motion relative to said seat frame to an attachment formed on said side frame rails.

9. The reclining chair of claim 8 wherein said friction means further comprises means for adjusting the friction between said slide member and said attachment.

10. The reclining chair of claim 9 wherein said friction means further comprising a friction disk interdisposed between said slide member and said attachment.

11. The reclining chair of claim 1 further comprising a seat cushion having a fastener strip for capturing a portion of said seat frame to releasably secure said seat cushion to said seat frame.

12. The reclining chair of claim 11 wherein said fastener strip has a J-shaped cross section for engaging a flange formed on said seat frame.

13. The reclining chair of claim 12 further comprising:

said front frame rail having a front attachment flange formed thereon;

said rear frame rail having a rear attachment flange formed thereon; and said seat cushion having a front fastener strip secured to a front portion of said seat cushion for capturing said front attachment flange and a rear fastener strip secured to a rear portion of said seat cushion for capturing said rear attachment flange to releasably secure said front and rear portions of said seat cushion to said seat frame.

14. The seat assembly of claim 13 further comprising:

said front frame rail having an intermediate attachment flange formed thereon and interdisposed between said front and rear attachment flanges;

said seat cushion having an intermediate fastener strip secured to said seat cushion between said front and rear fastener strip for capturing said intermediate attachment flange.

15. A reclining chair comprising:

an actuation mechanism having first and second shafts;

a chair frame having side frame members interconnectable to a front cross frame member and a rear cross frame member, wherein said front and rear cross frame members are metal components;

a seat assembly including a seat frame having a pair of side frame rails connecting a front frame rail and a rear frame rail to form a substantially rectangular frame and at least one seat spring disposed within said rectangular frame for supporting a seat cushion; a seat back detachably secured to said seat assembly; swing link means for pivotally interconnecting said seat back and said seat frame to permit reclining movement of said seat assembly with respect to the chair frame between an upright position and a reclined position in response to pressure applied by a seat occupant to said seat back, said swing link means connected to the chair frame to suspend said seat assembly therebetween; and guide means suspended from said first shaft for guiding and limiting the longitudinal movement of said seat frame in response to reclining movement of said seat assembly, said guide means including a pair of slide brackets having a lost-motion slot formed therein which are securable to a forward portion of said seat frame.

16. The reclining chair of claim 15 wherein said guide means are selectively securable to said side frame rails in a first and second position such that the angular relationship between said guide means and said seat frame can be varied thereby adjusting vertical movement of said seat frame relative to the chair frame in association with a fore and aft longitudinal movement thereof.

17. The reclining chair of claim 16 wherein said side frame rails include a vertical wall portion having a front attachment hole and at least two rear attachment holes formed therethrough and wherein said guide means is secured to said side frame rails at said front attachment hole and one of said at least two rear attachment holes by threaded fasteners.

18. The reclining chair of claim 17 wherein said guide means further comprises a nylon insert disposed within said lost-motion slots.

19. The reclining chair of claim 15 wherein said at least one seat spring is disposed between said front and rear frame rails and selectively positionable at a lateral location within said seat frame.

20. The reclining chair of claim 19 further comprising:

said front frame rail having a flange with a first set of holes therethrough;

said rear frame rail having a flange with a second set of holes therethrough; and said at least one seat spring having a clip disposed on one end and extending through one of said first set of holes for attaching said at least one spring to said front frame rail and a hook formed on the opposite end and extending through one of said second set of holes for attaching said at least one spring to said rear frame rail, said first and second set of holes defining said lateral location.

21. The reclining chair of claim 15 wherein said seat assembly further comprises friction means operably connected between said swing link means and said seat frame for resisting the reclining movement of said seat assembly in response to relative motion between said seat frame and said seat back.

22. The reclining chair of claim 21 wherein said friction means comprises a slide member disposed on each side of said seat frame adjacent said side frame rails, each of said slide members having a first end pivotally coupled to said swing link means opposite said connection to said chair frame and a second end coupled to an attachment formed on said side frame rails and adapted for sliding motion relative to said seat frame.

23. The reclining chair of claim 22 wherein said friction means further comprises means for adjusting the friction between said slide member and said attachment.

24. The reclining chair of claim 23 wherein said friction means further comprising a friction disk interdisposed between said slide member and said attachment.

25. The reclining chair of claim 15 further comprising a seat cushion having a fastener strip for capturing a portion of said seat frame to releasably secure said seat cushion to said seat frame.

26. The reclining chair of claim 25 wherein said fastener strip has a J-shaped cross section for engaging a flange formed on said seat frame.

27. The reclining chair of claim 26 further comprising:

said front frame rail having a front attachment flange formed thereon;

said rear frame rail having a rear attachment flange formed thereon; and said seat cushion having a front fastener strip at a front portion of said seat cushion capturing said front attachment flange and a rear fastener strip at a rear portion of said seat cushion capturing said rear attachment flange for releasably securing said front and rear portions of said seat cushion to said seat frame.

28. The reclining chair of claim 27 further comprising:

said front frame rail having an intermediate attachment flange formed thereon and interdisposed between said front and rear attachment flanges;

said seat cushion having an intermediate fastener strip on said seat cushion in between said front and rear fastener strips capturing said intermediate attachment flange.

29. The reclining chair of claim 15 further comprising a front facia for upholstering said front cross frame member, said front facia including a fabric panel for covering a portion of said front cross frame member and a fastener strip secured to said fabric panel and releasably attachable to said front cross frame member.

30. The reclining chair of claim 29 wherein said front facia further comprises a backing board.

31. The reclining chair of claim 29 wherein a lower edge of said fabric panel is releasably attachable to said front cross frame member by a J-strip and said front facia further includes a fastener for releasably attaching an upper portion of said fabric panel.

32. The reclining chair of claim 15 further including a leg rest assembly operably supported between said first shaft and a drive rod, said leg rest assembly being movable between a retracted position and an extended position in response to selective rotation of said drive rod.

33. The reclining chair of claim 32 wherein said leg rest assembly includes a leg rest frame board and pantograph linkage means journally suspended on said first shaft and drivingly coupled to said drive rod for moving said leg rest frame board between said retracted and extended positions in response to selective actuation of said drive rod.

34. The reclining chair of claim 33 wherein said chair frame is interconnected to a base assembly so as to permit rocking movement of said chair frame with respect to said base assembly, and wherein said rocking movement is independent of said reclining movement between said seat frame and said seat back.

35. The reclining chair of claim 34 further including a locking mechanism between said base assembly and said chair frame operable in a first mode for releasably locking said chair frame in a rearwardly tilted position, and in a second mode to permit said rocking movement, said locking mechanism movable between said modes in response to rotation of said drive rod.

36. A reclining chair comprising:

a chair frame having a pair of side frame members, a front cross rail member interconnected to a front portion of said side frame members, and a rear cross rail member interconnected to a rear portion of said side frame members;

an actuation mechanism suspended within said chair frame from said side frame members and said front cross rail member;

a seat assembly having a seat including a vertical flange formed on said seat to position said seat closely adjacent said actuation mechanism, a seat back, and swing link means for pivotally interconnecting said seat back and said seat;

suspension means connecting said swing link means to said side frame members for suspending said seat assembly therebetween, said swing link means operable to permit reclining movement of said seat assembly with respect to said chair frame between an upright position and a reclined position in response to pressure applied to said seat back; and guide means connecting said seat to said actuation mechanism along said vertical flange for guiding longitudinal movement of said seat in response to said reclining movement of said seat assembly.

37. The reclining chair of claim 36 wherein said seat is a non-wooden component.

38. A reclining chair comprising:

an actuation mechanism having first and second shafts;

a chair frame having side frame members interconnectable to a front cross rail member and a rear cross rail member wherein said front and rear cross rail members are metal components;

a seat assembly including a seat back, a seat member including a vertical flange formed on said seat member to position said seat member closely adjacent said actuation mechanism, and swing linkage means for pivotably interconnecting said seat member and said seat back to permit reclining movement therebetween in response to pressure applied to said seat back;

means for connecting said swing linkage means to said side frame members;

guide means connecting said seat assembly to said actuation mechanism along said vertical flange for permitting fore and aft longitudinal movement of said seat member with respect to said chair frame, said guide means being operably associated with said first shaft for defining the limits of said fore and aft movement of said seat member; and detachable means for securing said seat back to said swing linkage means such that said seat back and said seat member are movable between an upright position and a reclined position.

39. The reclining chair of claim 38 wherein said guide means is connected to said seat member along said vertical flanges.

40. The reclining chair of claim 39 wherein said vertical flange further includes a notch formed therein and said notch is disposed about said first shaft.

41. The reclining chair of claim 40 wherein said guide means is further aligned adjacent said notch.

42. The reclining chair of claim 41 wherein said seat member includes upstanding posts and wherein said swing linkage means are pivotably connected to said upstanding posts.

43. The reclining chair of claim 42 further comprising means associated with said swing linkage means and said seat member for providing an adjustable amount of resistance to said reclining movement.

* * * * *

UNITED STATES PATENT AND TRADEMARK OFFICE

CERTIFICATE OF CORRECTION

PATENT NO. : 5,570,930

DATED : November 5, 1996

INVENTOR(S) : Larry P. LaPointe, et al.

It is certified that error appears in the above-indentified patent and that said Letters Patent is hereby corrected as shown below:

On the Title Page under U.S. Patent Documents;

Insert the following -- 4,147,336 4/1979 Yamawaki et al
4,815,717 3/1989 Crosby
4,065,182 12/1977 Braniff et al
4,365,840 12/1982 Kehl et al
3,525,549 8/1970 Knabusch et al --

Signed and Sealed this

Thirteenth Day of May, 1997

Bruce Lehman

*Attest:*

BRUCE LEHMAN

*Attesting Officer*

*Commissioner of Patents and Trademarks*